United States Patent [19]

Cronin

[11] Patent Number: 4,971,568

[45] Date of Patent: Nov. 20, 1990

[54] ELECTRICAL CONNECTOR WITH ATTACHMENT FOR AUTOMATICALLY SHORTING SELECT CONDUCTORS UPON DISCONNECTION OF CONNECTOR

[75] Inventor: David V. Cronin, Peabody, Mass.

[73] Assignee: Polaroid Corporation, Cambridge, Mass.

[21] Appl. No.: 448,228

[22] Filed: Dec. 11, 1989

[51] Int. Cl.[5] ..... H01R 13/703

[52] U.S. Cl. ..... 439/188; 200/51.1; 439/510

[58] Field of Search ..... 439/181, 188, 189, 507, 439/510, 513, 514, 515; 200/51.09, 51.01

[56] References Cited

U.S. PATENT DOCUMENTS

| | | | |
|---|---|---|---|
| Re. 32,760 | 10/1988 | Chandler et al. | 439/188 |
| 2,197,426 | 4/1940 | Del Camp | 200/51.1 |
| 3,467,940 | 9/1969 | Wallo | 439/188 |
| 3,600,531 | 8/1971 | Hoegerl | 200/51.1 |
| 3,851,944 | 12/1974 | Ganzert et al. | 339/19 |
| 4,070,557 | 1/1978 | Ostapovitch | 200/51.1 |
| 4,179,178 | 12/1979 | Bachman et al. | 339/111 |
| 4,699,443 | 10/1987 | Goodrich et al. | 439/188 |
| 4,786,258 | 11/1988 | Schaffer et al. | 439/188 |
| 4,798,542 | 1/1989 | Asick et al. | 439/188 |

*Primary Examiner*—Neil Abrams

*Attorney, Agent, or Firm*—Edward S. Roman

[57] ABSTRACT

For an electrical connector member which has a plurality of pins which mates with a complementary receptacle member, there is provided a shorting member comprising a thin conductive sheet having a base portion fixedly connected with respect to the connector member in spaced relation with respect to the pins and a plurality of thin elongated arm portions each integrally connected at one end to the base portion and cantilevered therefrom to extend past at least a respective one of the pins, the other end of each arm portion extending laterally outward so as to electrically contact a side of the pin past which that arm portion extends, each of the arm portions having an inherent spring bias so as to urge its laterally extending end portion away from the connector member and into electrical contact with a respective pin so as to short a select number of pins upon disconnection of the connector and receptacle members.

8 Claims, 3 Drawing Sheets

ELECTRICAL CONNECTOR WITH ATTACHMENT FOR AUTOMATICALLY SHORTING SELECT CONDUCTORS UPON DISCONNECTION OF CONNECTOR

BACKGROUND OF THE INVENTION

1. Field of the Invention

This invention relates generally to an electrical connector and receptacle assembly in which selected pins or conductive elements of the connector are automatically shorted upon disconnection.

2. Description of the Prior Art

For an electrical connector member which mates with a complementary member, it is often necessary upon disconnection that a plurality of the pins or conductive elements of the connector member automatically be shorted with respect to each other in order to protect electrical components from damage as a result of static electrical shock. Arrangements for opening the selectively shorted pins of the connector member upon mating with its complementary receptacle member have generally relied on specially configured surfaces on the receptacle member to operate. Thus, the electrical connector and receptacle members must be specially configured to provide the requisite shorting and opening of selected pins upon disconnect and connect, respectively, thereby adding undue complexity and expense.

One electrical connector-receptacle arrangement that provides for an automatic shorting upon disconnection and opening upon connection which does not require specially configured receptacle surfaces is disclosed in U.S. Pat. No. 3,467,940 entitled "Electrical Connecting Spring Device", by W. H. Wallo, issued Sept. 16, 1969. This patent shows a coiled compression spring mounted in a separable plug and jack connector assembly wherein the spring automatically expands and grounds the plug in the absence of the jack. The spring is automatically compressed upon insertion of the jack into the plug and compressed so as to separate and electrically disconnect from the plug. This arrangement can operate with a standard jack and therefore does not require that the receptacle end of the connector have specially configured surfaces to be operable. However, the coiled compression spring is shown as operating on only a single pin or elongated electrical connector element and would be difficult to adapt to a connector of the type having a plurality of closely spaced apart pins or elongated conductive elements.

Therefore, it is a primary object of this invention to provide an electrical connector-receptacle arrangement in Which a connector member of the type having a plurality of spaced apart conductive elements or pins operates in a simple and economical manner to short a select number of its pins upon its disconnection from a complementary receptacle member.

It is a further object of this invention to provide an electrical connector-receptacle assembly in which a connector member having a plurality of spaced apart conductive elements or pins operates to automatically open the short between selected ones of the pins upon its connection to a standard receptacle member which has not been specially adapted to effect such opening.

Other objects of the invention will be in part obvious and will in part appear hereinafter. The invention accordingly comprises a system possessing a construction, combination of elements and arrangement of parts which are exemplified in the following detailed disclosure.

SUMMARY OF THE INVENTION

An electrical connector and receptacle assembly comprises a connector member configured to define a first substantially planar surface. A plurality of elongated conductive elements or pins extend outward from the planar surface in substantially parallel spaced apart insulated relation with respect to each other. A receptacle member is provided for mating connection with the connector member and is configured to define a second substantially planar surface. A plurality of elongated receptacles extend inward from the second planar surface in substantially parallel spaced apart relation with respect to each other and in complementary receiving relation with respect to the elongated conductive elements or pins so as to accommodate insertion of the elongated conductive elements or pins into respective ones of the receptacles.

A shorting member comprises a thin conductive sheet having a base portion fixedly connected with respect to the connector member in spaced relation with respect to each of the elongated conductive elements. A plurality of thin elongated arm portions are each integrally connected at one end to the base portion and cantilevered therefrom so as to extend past at least a respective one of the elongated conductive elements or pins with the other end of each arm portion extending laterally outward so as to be in contacting relation with respect to a select side of that elongated conductive element or pin past which its respective arm portion extends. Each of the arm portions has an inherent resilient bias so as to urge its other laterally extending end away from the first planar surface and into electrically contacting engagement with the select side of that elongated conductive element or pin past which that arm portion extends. The insertion of the elongated conductive elements or pins of the connector member into the complementary receptacles of the receptacle member operate to bring the second planar surface of the receptacle member into engagement with the laterally extending other ends of the arm portions so as to deflect the arm portions against the inherent resilient bias towards the first planar surface and out of electrical connection to respective ones of the elongated conductive elements or pins.

In one embodiment, the elongated conductive elements or pins and complementary receptacles are arranged in respective spaced apart linear relation. A first one of the arm portions extends past at least two of the linearly spaced apart elongated conductive elements or pins and the other end of the first arm portion extends laterally outward so as to be resiliently biased into electrical contact with the select side of the last elongated conductive element or pin past which that first arm portion extends. A second one of the arm portions overlies the first arm portion and extends past at least one of the linearly spaced apart conductive elongated elements or pins but not past the last elongated conductive element or pin past which the first one of said arm portions extends and the other end of the second arm portion extends laterally outward so as to be resiliently biased into electrical contact with the select side of the last elongated conductive element or pin past which the second arm portion extends. Insertion of the elongated conductive elements or pins of the connector member into the complementary receptacles of the receptacle member operate to bring the second planar surface of the receptacle member into engagement with the laterally extending other ends of the first and second arm portions so as to deflect the arm portions against their inherent resilient bias, towards the first planar surface and out of electrical connection to respective ones of the elongated conductive elements or pins.

In an alternative embodiment, the elongated conductive elements or pins and complementary receptacles are arranged, respectively, in a spaced apart circumferential relationship. The base portion of the shorting member is fixedly connected within the area bounded by the circumferentially spaced apart elongated conductive elements or pins. A first one of the arm portions extends from the area bounded by the circumferentially spaced apart elongated conductive elements or pins past a first one of the elongated conductive elements or pins and the other end of the first arm portion extends laterally outward so as to be resiliently biased into electrical contact with the select side of the first elongated conductive element or pin. A second one of the arm portions extends from the area bounded by the circumferentially spaced apart elongated conductive elements or pins past a second one of the elongated conductive elements or pins and the other end of the second arm portion extends laterally outward so as to be resiliently biased into electrical contact with the select side of the second elongated conductive element or pin. Insertion of the elongated conductive elements or pins of the connector member into the complementary receptacles of the receptacle member operate to bring the second planar surface of receptacle member into engagement with the laterally extending other ends of the first and second arm portions so as to deflect the arm portions against their inherent resilient bias towards the first planar surface and out of electrical connection to the first and second elongated conductive leads, respectively.

DESCRIPTION OF THE DRAWINGS

The novel features that are considered characteristic of the invention are set forth with particularity in the appended claims. The invention itself, however, both as to its organization and its method of operation together with other objects and advantages thereof will be best understood from the following description of the illustrated embodiment when read in connection with the accompanying drawings wherein:

DESCRIPTION OF THE PREFERRED EMBODIMENTS

Figure 1:
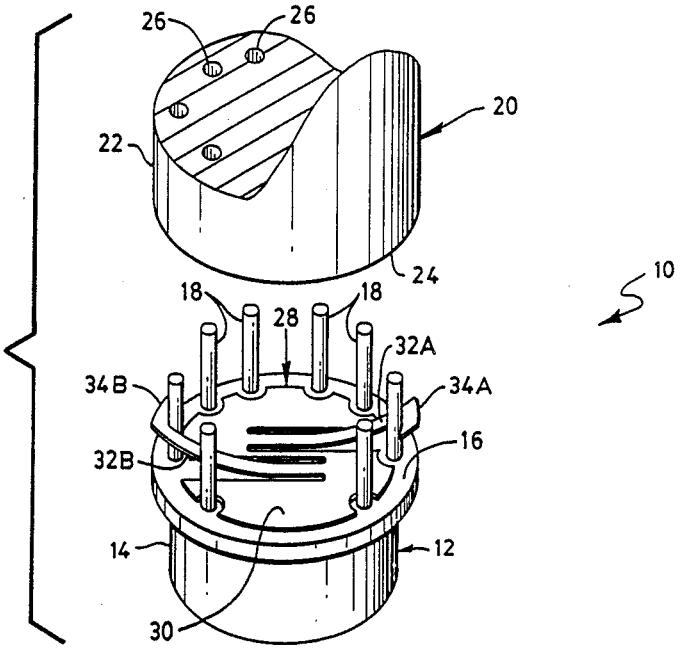
FIG. 1 is a perspective view of the electrical connector and shorting member of this invention.
Figure 2:
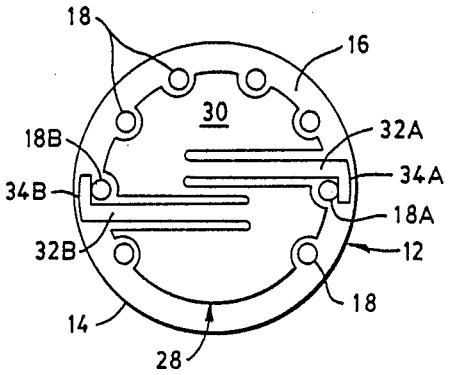
FIG. 2 is a top plan view of the electrical connector and shorting member of FIG. 1.
Figure 3:
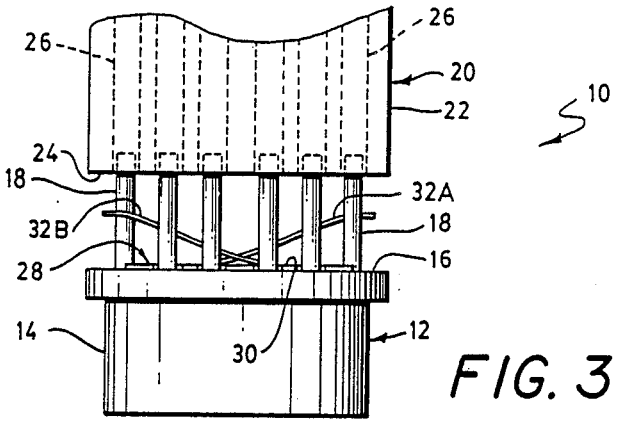
FIG. 3 is a side view of the electrical connector and shorting member of FIG. 1 partially inserted into a complementary receptacle member.

Referring now to FIGS. 1–3, there is shown generally at 10 the electrical connector and receptacle assembly of this invention comprising a connector member 12 and a receptacle member 20. The connector member 12 in one embodiment may comprise a generally cylindrical housing 14 having a substantially planar surface 16 at one end thereof. A plurality of elongated conductive elements or pins 18 extend from the planar surface 16 in substantially parallel, spaced apart, insulated relation with respect to each other. The conductive elements or pins 18 are preferably circumferentially disposed with respect to each other so as to define a circular arrangement. As will be readily understood, the housing 14 may house a single electrical component such as an integrated circuit, a laser, a light emitting diode, etc., or a plurality of such electrical components. Alternatively, the housing 14 may simply house the electrical connection between the conductive elements or pins 18 and a plurality of corresponding lead wires which ultimately connect to other electrical components remotely stationed with respect to the connector housing 14 in a well-known manner.

The connector member 12 is adapted for ready insertion or withdrawal from the complementary receptacle member 20 which comprises a housing 22 defining a substantially planar surface 24 on one select face thereof. A plurality of elongated receptacles 26 extend inward from the planar surface 24 in substantially parallel spaced apart insulated relation with respect to each other and in complementary relation with respect to the elongated conductive elements or pins 18 so as to accommodate ready insertion of the elongated conductive elements or pins 18 into respective ones of the receptacles 26.

As is readily apparent, connection of the connector member 12 to the receptacle member 20 by insertion of the elongated conductive elements or pins 18 into respective corresponding ones of the receptacles 26 operates to bring the planar surface 16 of the connector member 12 into overlapping substantially contiguous relation with respect to the substantially planar surface 24 of the receptacle member 20. The receptacle member housing 22 aside from the planar surface 24 may have any convenient shape or form and may operate to house either a single electrical component or a plurality of electrical components such as previously recited with respect to the connector housing 14. Alternatively, the receptacle housing 22 may simply operate to house a plurality of connections between the receptacles 26 and corresponding lead wires which ultimately connect to other electrical components remotely stationed with respect to the receptacle housing 22.

In order to ensure that selected ones of the conductive elements 18 are shorted upon the disconnection of the connector member 12 from the receptacle member 20, there is provided a shorting member as shown generally at 28 comprising a thin conductive sheet having a base portion 30 fixedly connected in overlying relationship with respect to the planar surface 16 of the connector member 12 and in spaced relation with respect to the conductive elements 18. The base portion 30 of the connector member 12 although preferably residing within the area bounded by the circumferentially spaced apart elongated conductive elements or pins 18, as shown, can alternatively be outside this area. The thin conductive sheet of the shorting member 28 is cut to define a plurality of thin elongated arm portions two of which are shown at 32A and 32B. The arm portions 32A and 32B are cantilevered from the base portion 30 so as to extend past at least a respective one of the elongated conductive elements or pins 18A and 18B. The other end of the arm portions 32 A and 32B extend laterally outward as shown at 34A and 34B so as to be in respective electrically contacting relation with respect to a select side of the conductive elements 18A and 18B past which said arm portions 32A and 32B respectively extend.

The arm portions 32A and 32B have an inherent resilient spring bias so as to urge their respective laterally extending ends 34A and 34B away from the planar surface 16 and into respective electrically contacting engagement with the select sides of the elongated conductive elements 18A and 18B past which the arm portions 32A and 32B respectively extend. Thus, as is readily apparent from FIGS. 1–3, when the electrical connector member 12 is disconnected from the receptacle member 20, arm portions 32A and 32B spring upward such that the laterally extending end portions 34A and 34B thereof respectively engage conductive elements or pins 18A and 18B so as to establish an electrical connection therebetween by way of the shorting member 28. In this manner, the shorting of select conductive elements or pins is accomplished so as to effect protection from static shock which can operate to damage electrical components connected thereto.

Insertion of the conductive elements 18 of the connector member 12 into the complementary receptacles 26 of the receptacle member 20 operates to move the planar surface 24 into engagement with the laterally extending ends 34A and 34B so as to break their electrical connection with conductive elements or pins 18A and 18B, respectively, and thereafter move their respective arm portions 32A and 32B against the force of their inherent resilient spring bias toward the planar surface 16 of the electrical connector member 12. In this manner, the inherent resilient spring biased arm portions 32A and 32B are substantially flattened between the planar surface 16 of the electrical connector 12 and the planar surface 24 of the receptacle member 20 so as to be out of electrical contact with any of the conductive elements or pins 18.

Figure 7:
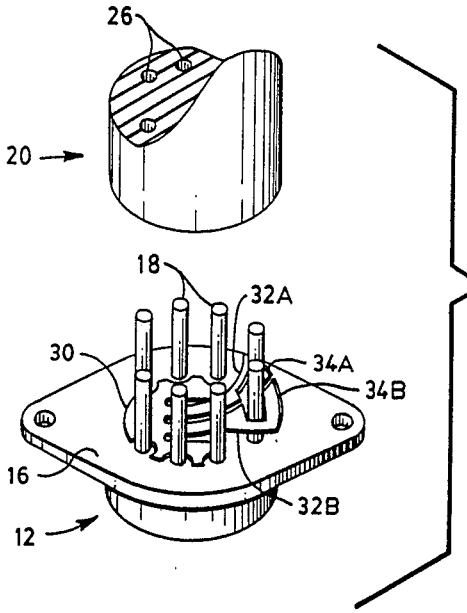
FIG. 7 is a perspective view of still another embodiment of the electrical connector and shorting member of this invention.

As will be readily apparent, the number of conductive elements of the connector member 12 to be shorted by the shorting member 28 is not just limited to the opposing pins 18A and 18B as shown at FIGS. 1–3 but may also include adjacent pins as shown in the embodiment of FIG. 7 where like numerals designate previously described elements. Moreover, the shorting member 28 is not limited to having only two shorting arm portions but may have any select number of arm portions extending past respective corresponding conductive elements so as to effectively short any select number of conductive elements upon disconnection of the connector member from the receptacle member. The shorting member 28 may comprise any metallized foil and may be fixedly connected with respect to the planar surface 16 of the connector member 12 by any conventional means such as a suitable adhesive or by tack welding.

Figure 4:
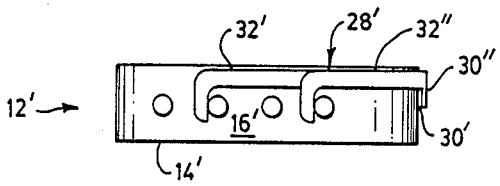
FIG. 4 is a top plan view of an alternate embodiment of the electrical connector and shorting member of this invention.
Figure 5:
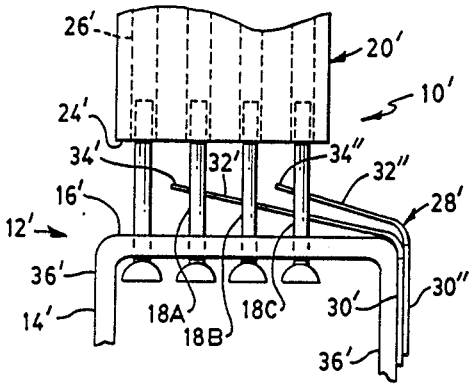
FIG. 5 is a side elevational view of the electrical connector and shorting member of FIG. 4 partially inserted into a complementary receptacle.
Figure 6:
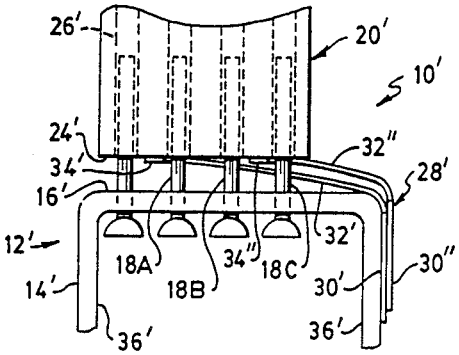
FIG. 6 is a side elevational view of the electrical connector and shorting member of FIG. 5 inserted further into the complementary receptacle.

Referring now to FIGS. 4–6 where like numerals designate previously described elements, there is shown an alternate embodiment for the electrical connector and receptacle assembly 10' of this invention. In contrast to the previous embodiment, the plurality of elongated conductive elements or pins 18 are arranged in linear spaced apart relationship with respect to each other. The connector member 12' further comprises a rectangularly shaped housing 14' having a substantially planar surface 16' and a plurality of depending side surfaces 36' substantially orthogonal to the planar surface 16'. The shorting member as shown generally at 28' comprises two overlapping thin conductive sheets each having base portions 30' and 30'', respectively, fixedly connected in contiguous relationship with respect to each other and the side surface 36'. Cantilevered from the underlying base portion 30' there is provided an arm portion 32' which extends past the conductive elements or pins 18A, 18B and 18C with the laterally extending end 34' thereof engaging a side of the conductive element or pin 18A. In like manner, cantilevered from the base portion 30'' there is provided a second arm portion 32'' extending past the conductive element or pin 18C with the laterally extending end portion 34'' thereof electrically contacting a select side of the conductive element or pin 18C.

Thus, as is readily apparent, when the electrical connector and receptacle are disconnected, the laterally extending end portions 34' and 34'' of the spring biased arm portions 32' and 32'' engage respectively the conductive elements or pins 18A and 18C so as to create an electrical short by way of the contacting base portions 30' and 30''.

Insertion of the conductive elements or pins 18 of the connector member 12 into the complementary receptacles 26' of the receptacle member 20' operate to move the planar surface 24' of the receptacle member 20' into engagement with the laterally extending portions 34' and 34'' so as to break the electrical connection to their respective conductive elements or pins 18A and 18C. Complete insertion of the connector member 12' with respect to the receptacle member 20' operates to substantially flatten the arm portions 32' and 32'' of the shorting member 28' between the planar surfaces 16' and 24' thereby electrically disconnecting the short between the conductive elements or pins 18A and 18C.

Although only two conductive elements or pins 18A and 18C are shown as being shorted upon the disconnection of the connector member 12' from the receptacle member 20', it will be readily understood that the invention is by no means so limited and any select number of pins may be shorted with respect to each other by simply adding additional overlying arm and base portions. Again, the base portions as shown at 30' and 30'' may be fixedly connected with respect to the side surface 36' by any conventional means such as a suitable adhesive or a tack weld so long as the base portions 30' and 30'' electrically contact each other. Thus, in this manner there is provided an electrical connector and receptacle assembly in which selected conductive elements may be selectively shorted upon disconnect in a simple and economical manner without specially configured hardware for the receptacle member.

Other embodiments of the invention including additions, subtractions, deletions and other modifications of the preferred disclosed embodiments of the invention will be obvious to those skilled in the art and are within the scope of the following claims.

What is claimed is:

1. An electrical connector comprising:

a connector member defining a substantially planar surface;

a plurality of elongated conductive elements extending from said planar surface in substantially parallel, spaced apart, insulated relation with respect to each other; and a shorting member comprising a thin conductive sheet having a base portion fixedly connected with respect to said connector member in spaced relation with respect to each of said elongated conductive elements, and a plurality of thin elongated arm portions each integrally connected at one end to said base portion and cantilevered therefrom so as to extend past at least a respective one of said elongated conductive elements, the other end of each of said arm portions extending laterally outward so as to be in electrically contacting relation with respect to a select side of that elongated conductive element past which that arm portion extends, each said arm portion having an inherent resilient bias so as to urge its said other laterally extending end away from said planar surface and into electrically contacting engagement with said select side of that elongated conductive element past which that arm portion extends.

2. The electrical connector of claim 1 wherein: said elongated conductive elements are arranged in spaced apart linear relation with respect to each other, a first one of said arm portions extends past at least two of said linearly spaced apart elongated conductor elements, and said other end of said first arm portion extends laterally outward so as to be resiliently biased into electrical contact with said select side of the last elongated conductive element past which said first arm portion extends, and a second one of said arm portions overlies said first arm portion and extends past at least one of said linearly spaced apart conductive elongated elements, but not past the last elongated conductive element past which said first one of said arm portions extends and said other end of said second arm portion extends laterally outward so as to be resiliently biased into electrical contact with said select side of the last elongated conductive element past which said second arm portion extends.

3. The electrical connector of claim 2 wherein: said connector member comprises a housing having a first surface which defines said planar surface from which said elongated conductive elements extend and a plurality of depending side surfaces substantially orthogonal to said first surface; and said base portion of said shorting member is fixedly connected with respect to a select one of said side surfaces.

4. The electrical connector of claim 1 wherein said elongated conductive elements are arranged in spaced apart circumferential relation with respect to each other; said base portion of said shorting member is fixedly connected within the area bounded by said circumferentially spaced apart elongated conductive elements; a first one of said arm portions extends from said area bounded by said circumferentially spaced apart elongated conductive elements past a first one of said elongated conductive elements and said other end of said first arm portion extends laterally outward so as to be resiliently biased into electrical contact with said select side of said first elongated conductive element; and a second one of said arm portions extends from said area bounded by said circumferentially spaced apart elongated conductive elements past a second one of said elongated conductive elements and said other end of said second arm portion extends laterally outward so as to be resiliently biased into electrical contact with said select side of said second elongated conductive element.

5. An electrical connector and receptacle assembly comprising:

a connector member defining a first substantially planar surface;

a plurality of elongated conductive elements extending outward from said first planar surface in substantially parallel, spaced apart, insulated relation with respect to each other;

a receptacle member defining a second substantially planar surface;

a plurality of elongated receptacles extending inward from said second planar surface in substantially parallel, spaced apart, insulated relation with respect to each other and in complementary relation with respect to said elongated conductive elements to accommodate insertion of said elongated conductive elements into respective ones of said receptacles; and a shorting member comprising a thin conductive sheet having a base portion fixedly connected with respect to said connector member in spaced relation with respect to each of said elongated conductive elements, and a plurality of thin elongated arm portions each integrally connected at one end to said base portion and cantilevered therefrom so as to extend past at least a respective one of said elongated conductive elements, the other end of each of said arm portions extending laterally outward so as to be in electrically contacting relation with respect to a select side of that elongated conductive element past which said arm portion extends, each said arm portion having an inherent resilient bias so as to urge its said other laterally extending end away from said first planar surface and into electrically contacting engagement with said select side of that elongated conductive element past which that arm portion extends, the insertion of the elongated conductive elements of said connector member into the complementary receptacles of said receptacle member operating to bring said second planar surface of said receptacle member into engagement with the laterally extending other ends of said arm portions so as to deflect said arm portions against their inherent resilient bias towards said first planar surface and out of electrical connection to respective ones of said elongated conductive elements.

6. The assembly of claim 5 wherein: said elongated conductive elements and complementary receptacles are arranged in respective spaced apart linear relation; a first one of said arm portions extends past at least two of said linearly spaced apart elongated conductive elements and said other end of said first arm portion extends laterally outward so as to be resiliently biased into electrical contact with said select side of the last elongated conductive element past which said first arm portion extends; a second one of said arm portions overlies said first arm portion and extends past at least one of said linearly spaced apart conductive elongated elements, but not past the last elongated conductive element past which said first one of said arm portions extends and said other end of said second arm portion extends laterally outward so as to be resiliently biased into electrical contact with said select side of the last elongated conductive element past which said second arm portion extends; and the insertion of the elongated conductive elements of said connector member into the complementary receptacles of said receptacle member operate to bring said second planar surface of said receptacle member into engagement with the laterally extending other ends of said first and second arm portions so as to deflect said arm portions against their inherent resilient bias, towards said first planar surface and out of electrical connection to respective ones of said elongated conductive leads.

7. The assembly of claim 6 wherein: said connector member comprises a housing having a first surface which defines said planar surface from which said elongated conductive elements extend and a plurality of depending side surfaces substantially orthogonal to said first surface; and said base portion of said shorting member is fixedly connected with respect to a select one of said side surfaces.

8. The assembly of claim 5 wherein said elongated conductive elements and complementary reoeptacles are arranged in respective spaced apart circumferential relation; said base portion of said shorting member is fixedly connected within the area bounded by said circumferentially spaced apart elongated conductive elements; a first one of said arm portions extends from said area bounded by said circumferentially spaced apart elongated conductive elements past a first one of said elongated conductive elements and said other end of said first arm portion extends laterally outward so as to be resiliently biased into electrical contact with said select side of said first elongated conductive element; a second one of said arm portions extends from said area bounded by said circumferentially spaced apart elongated conductive elements past a second one of said elongated conductive elements and said other end of said second arm portion extends laterally outward so as to be resiliently biased into electrical contact with said select side of said second elongated conductive element; and, the insertion of the elongated conductive elements of said connector member into the complementary receptacles of said receptacle member operate to bring said second planar surface of said receptacle member into engagement with the laterally extending other ends of said first and second arm portions so as to deflect said arm portions against their inherent resilient bias, towards said first planar surface and out of electrical connection to said first and second elongated conductive leads, respectively.

* * * * *